US009662901B2

(12) United States Patent
Ding et al.

(10) Patent No.: US 9,662,901 B2
(45) Date of Patent: May 30, 2017

(54) PRINTER AND CONTROL METHOD FOR PRINTER

(71) Applicant: SHANDONG NEW BEIYANG INFORMATION TECHNOLOGY CO., LTD, Weihai (CN)

(72) Inventors: Jinfeng Ding, Weihai (CN); Guokai Wang, Weihai (CN); Guangdong Hu, Weihai (CN); Xin Wang, Weihai (CN)

(73) Assignee: SHANDONG NEW BEIYANG INFORMATION TECHNOLOGY CO., LTD, Weihai (CN)

( * ) Notice: Subject to any disclaimer, the term of this patent is extended or adjusted under 35 U.S.C. 154(b) by 0 days.

(21) Appl. No.: 14/651,916

(22) PCT Filed: Dec. 10, 2013

(86) PCT No.: PCT/CN2013/088978
§ 371 (c)(1),
(2) Date: Jun. 12, 2015

(87) PCT Pub. No.: WO2014/094560
PCT Pub. Date: Jun. 26, 2014

(65) Prior Publication Data

US 2015/0328902 A1 Nov. 19, 2015

(30) Foreign Application Priority Data

Dec. 17, 2012 (CN) ..... 2012 1 0549984

(51) Int. Cl.
*B41J 2/36* (2006.01)
*B41J 2/37* (2006.01)
*B41J 2/365* (2006.01)

(52) U.S. Cl.
CPC ..... *B41J 2/362* (2013.01); *B41J 2/36* (2013.01); *B41J 2/365* (2013.01); *B41J 2/37* (2013.01)

(58) Field of Classification Search
CPC ..... B41J 2/362; B41J 2/37; B41J 2/365; B41J 2/36
See application file for complete search history.

(56) References Cited

U.S. PATENT DOCUMENTS 5,131,767 A 7/1992 Yamada et al.
2004/0196353 A1 10/2004 Hosokawa et al.
(Continued)

FOREIGN PATENT DOCUMENTS

CN 1504339 A 6/2004
CN 1769058 A 5/2006
(Continued)

OTHER PUBLICATIONS

Translation of JP 07-081122 A. (JP 07-081122 A was published on Mar. 28, 1995.).*
(Continued)

*Primary Examiner* — Justin Seo
(74) *Attorney, Agent, or Firm* — Shumaker & Sieffert, P.A.

(57) ABSTRACT

A control method for printer, the control method includes: controlling a first group of heating units of a printing head to output first printing energy to form printing dots with a first density on a printing medium; and controlling a second group of heating units of the printing head to continue outputting second printing energy to form printing dots with a second density on the printing medium, wherein the second group of heating units consists of heating units need to implement printing energy compensation in the first group of heating units. By means of the control method, the
(Continued)

printing densities of the printing dots corresponding to the heating units need to implement printing energy compensation are improved, and the problem of non-uniform printing density of each printing dot caused by non-uniform pressure exerted on the printing platen by the printing head can be effectively solved.

8 Claims, 5 Drawing Sheets

(56) References Cited

U.S. PATENT DOCUMENTS

| | | | |
|---|---|---|---|
| 2006/0098038 | A1 | 5/2006 | Im |
| 2006/0152573 | A1 | 7/2006 | Busch et al. |

FOREIGN PATENT DOCUMENTS

| | | | |
|---|---|---|---|
| CN | 102133820 | A | 7/2011 |
| JP | H0781122 | A | 3/1995 |

OTHER PUBLICATIONS

International Search Report for counterpart PCT Application No. PCT/CN2013/088978, dated Mar. 20, 2014 (8 pgs.).

* cited by examiner

PRINTER AND CONTROL METHOD FOR PRINTER

This application is a national stage entry under 35 U.S.C. 371 of PCT Application No. PCT/CN2013/088978 filed on Dec. 10, 2013 in the name of Shandong New Beiyang Information Technology Co., LTD., which claims priority to Chinese Invention Patent Application No. 201210549984.X, entitled "Printer and Control Method for Printer", filed in State Intellectual Property Office on Dec. 17, 2012. The entire contents of PCT/CN2013/088978 and Chinese Invention Patent Application No. 201210549984.X are incorporated herein by reference.

TECHNICAL FIELD OF THE INVENTION

The disclosure relates to the field of printing, in particular to printer and control method for printer.

BACKGROUND OF THE INVENTION

At present, a thermal printer is applied more and more widely. A printing mechanism of the thermal printer includes a thermal printing head and a printing platen, the thermal printing head and the printing platen are tangentially arranged, printing supplies penetrate through a part between the thermal printing head and the printing platen, multiple heating units arranged in a line at an equal interval along a width direction of the printing head are arranged on the printing head, and when the printer executes a printing task, the heating units are controlled to emit heat, thereby produce energy (called printing energy for short), and the printing energy is transferred to the printing supplies contacting with the thermal printing head, wherein the printing supplies in a direct thermal printer refers to a thermal printing medium, and a thermal layer on a surface of the thermal printing medium is chemically changed by the printing energy, thereby developing a colour and forming printing dots corresponding to the heating units one to one; and in a thermal transfer printer, the printing supplies include a common printing medium and a thermal transfer ribbon, and a pigment substance on the thermal transfer ribbon is heated by the printing energy, and melted and transferred onto a surface of the common printing medium to form the printing dots corresponding to the heating units one to one.

When the parallelism of the printing head and the printing platen installed in the printer is inconsistent under the influence of an assembly error or a machining error, pressure exerted on the printing platen by the printing head is non-uniform, so that the printing energy transferred to the printing supplies is inconsistent when the heating units emitting heat, a printing density of each printing dot on the printing medium is non-uniform, and an abnormal printing effect is caused. FIG. 1 shows a printed image with an abnormal printing effect caused by non-uniform pressure exerted on the printing platen by the printing head, and in the image, the printing energy transferred to the printing supplies is non-uniform because the pressure exerted on the printing platen by the printing head is non-uniform, and "white spots" as shown in FIG. 1 are formed on parts with insufficient printing energy.

Chinese patent with the application number of CN200310120787.7 discloses a method for compensating printing energy, and according to the method, the printing energy output by the printing head in a printing dot line with a requirement on printing energy compensation is compensated by regulating a duration of a valid strobe signal applied to the printing head; however, when the printing energy is compensated by the method, the printing energy output by all the heating units of the printing head required to emit heat in printing a dot line may be compensated, and the printing density of the printing dot line of the image is improved overall; therefore, by the method, the problem of non-uniform printing density of each printing dot caused by non-uniform pressure exerted on the printing platen by the printing head cannot be solved.

For the problem that the non-uniform printing density of each printing dot caused by non-uniform pressure exerted on the printing platen by the printing head cannot be effectively avoided by printing energy compensation in a related art, there is yet no effective solution.

SUMMARY OF THE INVENTION

A main purpose of the disclosure is to provide a printer and control method for printer, so as to solve the problem that a non-uniform printing density of each printing dot caused by non-uniform pressure exerted on the printing platen by the printing head cannot be effectively avoided by printing energy compensation in the related art.

In order to achieve the purpose, according to one aspect of the disclosure, a control method for printer is provided. The control method for the printer includes: controlling a first group of heating units of a printing head to output first printing energy to form printing dots with a first density on a printing medium, wherein the first printing energy is printing energy output by the first group of heating units according to corresponding bits of first dot matrix data, and the first dot matrix data is dot matrix data obtained by processing received printing data; and controlling a second group of heating units of the printing head to continue outputting second printing energy to form printing dots with a second density on the printing medium, wherein the second printing energy is printing energy output by the second group of heating units according to corresponding bits of second dot matrix data, the second dot matrix data is dot matrix data obtained by processing the first dot matrix data and configured for printing energy compensation, and the second group of heating units consists of heating units need to implement printing energy compensation in the first group of heating units.

Furthermore, controlling the first group of heating units of the printing head to output the first printing energy to form the printing dots with the first density on the printing medium includes: transmitting the first dot matrix data to a printing head driver; controlling the printing head driver to latch the bits of the first dot matrix data into the corresponding heating units; and transmitting a first valid strobe signal with a duration of T to the printing head driver to control the first group of heating units to output the first printing energy. Controlling the second group of heating units of the printing head to continue outputting the second printing energy to form the printing dots with the second density on the printing medium includes: transmitting the second dot matrix data to the printing head driver; controlling the printing head driver to latch the bits of the second dot matrix data into the corresponding heating units; and transmitting a second valid strobe signal with a duration of $\Delta t$ to the printing head driver to control the second group of heating units to output the second printing energy. Wherein, $\Delta t = p*T$, and p is a compensated energy percentage preset according to the printing density of the printing dots after the transmission of the first dot matrix data.

Furthermore, the first valid strobe signal includes multiple third valid strobe signals, and in a process of printing one-dot line dot matrix data by the printer, the multiple third valid strobe signals are transmitted to the printing head driver, and the sum of durations of the multiple third valid strobe signals is T. Wherein, that the multiple third valid strobe signals are transmitted to the printing head driver includes that: the third valid strobe signals are transmitted to the printing head driver at a preset time interval of T0, and the duration of each third valid strobe signal is T/(n−1). Wherein, n is an integer more than 1, and is the number of strobing times of the printing head when the one-dot line dot matrix data is printed by the printer when printing energy compensation is not required, and the preset time interval T0 is longer than the duration T/(n−1).

Furthermore, before controlling the second group of heating units of the printing head to continue outputting the second printing energy to form the printing dots with the second density on the printing medium, the method further includes: reading a printing compensation Flag stored in a Random Access Memory (RAM) of the printer to judge whether the printer needs printing energy compensation or not, wherein the second group of heating units of the printing head is controlled to continue outputting the second printing energy to form the printing dots with the second density on the printing medium when the printer is determined to need to implement printing energy compensation.

Furthermore, the second dot matrix data is obtained by: acquiring sequence numbers of first heating units, acquiring sequence numbers of second heating units, performing first processing on the first dot matrix data according to the sequence numbers of the first heating units, and performing second processing on the first dot matrix data according to the sequence numbers of the second heating units. Wherein, performing first processing on the first dot matrix data according to the sequence numbers of the first heating units includes: performing first processing on the bits of the first dot matrix data corresponding to the first heating units to keep the bits of the second dot matrix data corresponding to the first heating units unchanged; and performing second processing on the first dot matrix data according to the sequence numbers of the second heating units includes: performing second processing on the bits of the first dot matrix data corresponding to the second heating units to make the bits of the second dot matrix data corresponding to the second heating units be invalid values. Wherein, the first heating units are heating units need to implement printing energy compensation, and the second heating units are heating units need not to implement printing energy compensation.

In order to achieve the purpose, according to the other aspect of the disclosure, a printer is provided. The printer includes: a printing unit, including a printing head and a printing head driver, wherein the printing head includes multiple heating units which are arranged in a line at an equal interval along a width direction of the printing head; and a control unit, configured to control a first group of heating units to output first printing energy to form printing dots with a first density on a printing medium and then control a second group of heating units to continue outputting second printing energy to form printing dots with a second density on the printing medium, wherein the first printing energy is printing energy output by the first group of heating units heating according to corresponding bits of first dot matrix data, the first dot matrix data is dot matrix data obtained by processing received printing data, the second printing energy is printing energy output by the second group of heating units heating according to corresponding bits of second dot matrix data, the second dot matrix data is dot matrix data obtained by processing the first dot matrix data and configured for printing energy compensation, and the second group of heating units consists of the heating units need to implement printing energy compensation in the first group of heating units.

Furthermore, the control unit is further configured to: transmit the first dot matrix data to the printing head driver, control the printing head driver to latch the bits of the first dot matrix data into the corresponding heating units, transmit a first valid strobe signal with a duration of T to the printing head driver to control the first group of heating units to output the first printing energy, transmit the second dot matrix data to the printing head driver, control the printing head driver to latch the bits of the second dot matrix data into the corresponding heating units, and transmit a second valid strobe signal with a duration of Δt to the printing head driver to control the second group of heating units to output the second printing energy, wherein Δt=p*T, and p is a compensated energy percentage preset according to the printing density of the printing dots after the transmission of the first dot matrix data.

Furthermore, the first valid strobe signal includes multiple third valid strobe signals, the control unit is configured to, in a process of printing one-dot line dot matrix data by the printer, transmit the multiple third valid strobe signals to the printing head driver, and the sum of durations of the multiple third valid strobe signals is T, wherein the control unit is configured to transmit the multiple third valid strobe signals to the printing head driver in a manner of: transmitting the third valid strobe signals to the printing head driver at a preset time interval of T0, and the duration of each third valid strobe signal is T/(n−1), wherein n is an integer more than 1, and is the number of strobing times of the printing head when the one-dot line dot matrix data is printed by the printer when printing energy compensation is not required, and the preset time interval T0 is longer than the duration T/(n−1).

Furthermore, the printer further includes: a RAM, configured to store a printing compensation Flag, and the control unit is further configured to, before controlling the second group of heating units of the printing head to continue outputting the second printing energy to form the printing dots with the second density on the printing medium, read the printing compensation Flag stored in the RAM of the printer to judge whether the printer needs printing energy compensation or not, and control the second group of heating units of the printing head to continue outputting the second printing energy to form the printing dots with the second density on the printing medium when the printer is determined to need to implement printing energy compensation.

Furthermore, the control unit is configured to obtain the second dot matrix data by: acquiring sequence numbers of first heating units, acquiring sequence numbers of second heating units, performing first processing on the first dot matrix data according to the sequence numbers of the first heating units, and performing second processing on the first dot matrix data according to the sequence numbers of the second heating units, wherein performing first processing on the first dot matrix data according to the sequence numbers of the first heating units includes: performing first processing on the bits of the first dot matrix data corresponding to the first heating units to keep the bits of the second dot matrix data corresponding to the first heating units unchanged; and performing second processing on the first dot matrix data according to the sequence numbers of the second heating units includes: performing second processing on the bits of the first dot matrix data corresponding to the second heating units to make the bits of the second dot matrix data corresponding to the second heating units be an invalid value, wherein the first heating units are heating units need to implement printing energy compensation, and the second heating units are heating units need not to implement printing energy compensation.

According to the disclosure, the heating units need to implement printing energy compensation continue outputting the second printing energy, namely compensation printing energy, after the first printing energy, i.e. basic printing energy, is output, so that the printing density of the printing dots corresponding to the heating units need to implement printing energy compensation are improved, and the problem of non-uniform printing density of each printing dot caused by non-uniform pressure exerted on the printing platen by the printing head can be effectively solved.

BRIEF DESCRIPTION OF THE DRAWINGS

The drawings forming a part of the disclosure are adopted to provide further understanding of the disclosure, and the schematic embodiments and description of the disclosure are adopted to explain the disclosure, and do not form improper limits to the disclosure. In the drawings.

DETAILED DESCRIPTION OF THE EMBODIMENTS

It should be noted that the embodiments of the disclosure and the characteristics in the embodiments can be combined under the condition of no conflicts. The disclosure is described below with reference to the drawings and the embodiments in detail.

Figure 1:
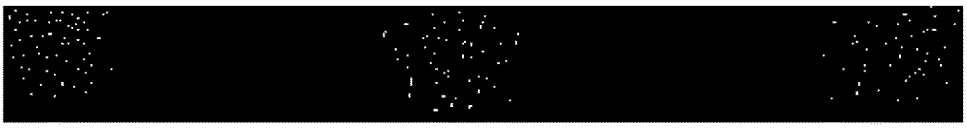
FIG. 1 is a printed image with an abnormal printing effect caused by non-uniform pressure exerted on the printing platen by the printing head in a prior art.
Figure 2:
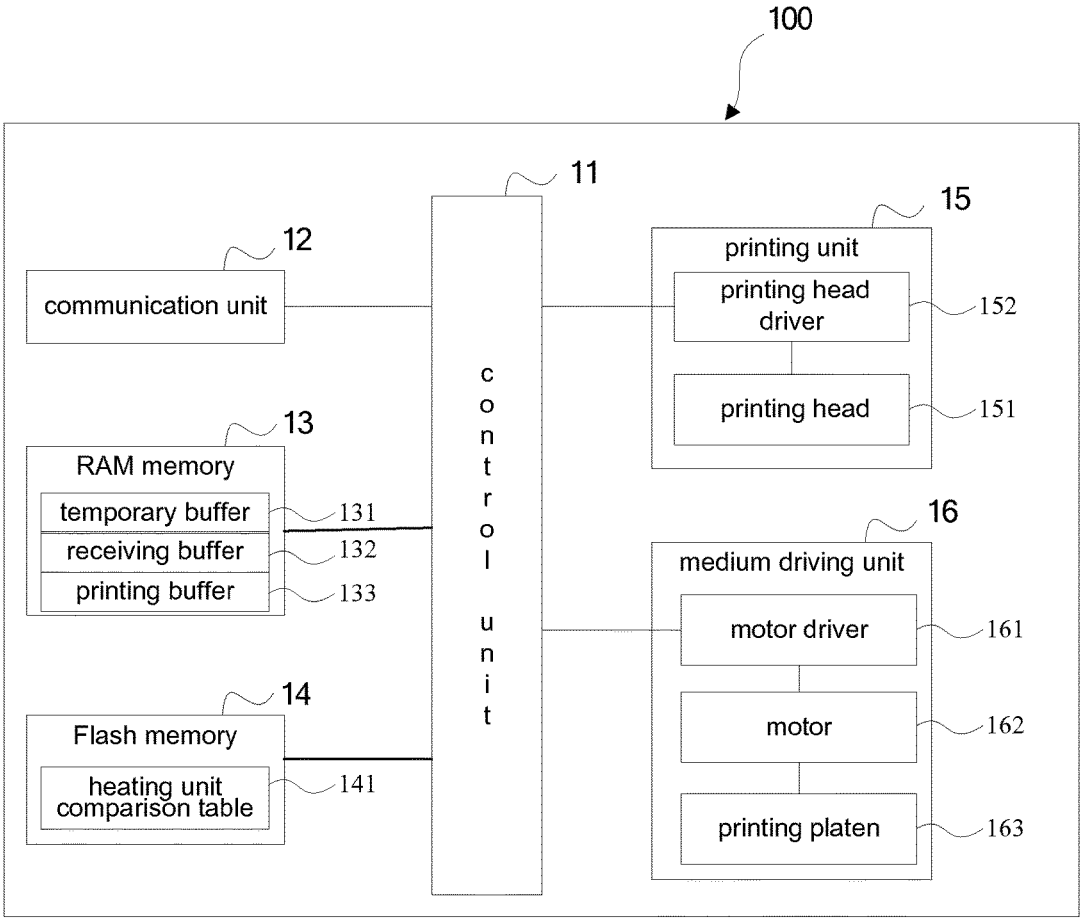
FIG. 2 is a composition diagram of a printer according to a first embodiment of the disclosure.

FIG. 2 is a composition diagram of a printer according to a first embodiment of the disclosure, and as shown in FIG. 2, the printer 100 includes a control unit 11, a communication unit 12, a RAM 13, a Flash memory 14, a printing unit 15 and a medium driving unit 16.

The control unit 11 is configured to control each module to execute work, and for example, the control unit 11 controls the communication unit 12 to execute data transmission between the printer 100 and a printing request device (such as a computer or network equipment); the control unit 11 processes printing data received by the communication unit 12, and generates dot matrix data to be transmitted to a printing head of the printing unit 15; the control unit 11 outputs a control signal for the printing head to control the printing head to finish printing the dot matrix data on a printing medium; and the control unit 11 controls the medium driving unit 16 to drive the printing medium to move in a medium conveying passage, etc.

The communication unit 12 is configured to execute data transmission between the printer 100 and the printing request device, and for example, the communication unit 12 receives a printing control command and printing data from the printing request device.

The RAM 13 includes a temporary buffer 131, a receiving buffer 132 and a printing buffer 133, wherein the temporary buffer 131 is configured to store data and variables, which are generated in a program running process, the receiving buffer 132 is configured to store the printing control command and the printing data, which are received by the communication unit 12, and the printing buffer 133 is configured to store one-dot line dot matrix data to be transmitted to the printing head of the printing unit 15, wherein a data length of the one-dot line dot matrix data is equal to the number of heating units of the printing head, bits of the dot matrix data correspond to the heating units of the printing head one to one, and the dot matrix data may be original dot matrix data as well as compensated dot matrix data, wherein the original dot matrix data refers to dot matrix data to be transmitted to the printing head, which is generated by processing the printing data received by the communication unit 12 by the control unit 11, and the compensated dot matrix data refers to dot matrix data to be transmitted to the printing head, which is generated by the calculation processing of the control unit 11 over the original dot matrix data.

The Flash memory 14 is configured to store a control program of the printer 100, and meanwhile, the Flash memory 14 is also configured to store a printing compensation Flag, a compensation sequence number N, a compensated energy percentage p and a heating unit comparison table 141, wherein the printing compensation Flag is configured to indicate whether printing energy compensation is required or not when the printer executes printing, the compensation sequence number N is configured to indicate a sequence number of a printing area where the heating units in the printing head need to implement are located during printing energy compensation, the compensated energy percentage p is configured to set the percentage of printing energy to be compensated (called compensated printing energy for short) in basic printing energy, the basic printing energy refers to printing energy output by the heating units after the transmission of the original dot matrix data, the heating unit comparison table 141 is configured to store a corresponding relationship between the compensation sequence number N and sequence numbers of the heating units of the printing head, table 1 is a heating unit comparison table of a printing head according to an embodiment of the disclosure, and shows the corresponding relationship between the compensation sequence number N and the sequence numbers of the heating units of the printing head, and as shown in table 1, the printing head includes totally 1,600 heating units with sequence numbers of 1~1,600, wherein every 160 heating units which are adjacently arranged in sequence on the printing head correspond to one compensation sequence number N, the control unit 11 looks up the heating unit comparison table when printing energy compensation is required, and acquires the sequence numbers of the heating units need to implement printing energy compensation according to the compensation sequence number N, and for example, when the compensation sequence number N is 1, the heating units, with the sequence numbers of 1~160, of the printing head need to implement printing energy compensation during printing.

TABLE 1

| | Compensation sequence number | | | | |
|---|---|---|---|---|---|
| | 1 | 2 | 3 | 4 | 5 |
| Sequence numbers of heating units | 1~160 | 161~320 | 321~480 | 481~640 | 641~800 |
| Compensation sequence number | 6 | 7 | 8 | 9 | 10 |
| Sequence numbers of heating units | 801~960 | 961~1,120 | 1,121~1,280 | 1,281~1,440 | 1,441~1,600 |

The printing unit 15 includes the printing head 151 and a printing head driver 152, wherein the printing head 151 includes multiple heating units which are arranged in a line at an equal interval along a width direction of the printing head, and when the printer executes printing, the heating units are controlled to emit heat to form printing dots on the printing medium; the printing head driver 152 is configured to receive the control signal output by the control unit 11 and the dot matrix data transmitted from the printing buffer 133, and sequentially transmit the bits of the dot matrix data to the corresponding heating units of the printing head 151 under the control of the control signal, wherein the control signal includes a clock signal CLK, a latch signal LATCH and a strobe signal STB; when the printer executes printing, the control unit 11 transmits each bit of the dot matrix data to the printing head driver 152 under the synchronization of the clock signal CLK, and transmits a valid latch signal (such as the latch signal LATCH is a low level) after the dot matrix data is transmitted, the printing head drivers 152 latches the bits of the dot matrix data into the corresponding heating units of the printing head 151, and the control unit 11 transmits a valid strobe signal (such as the strobe signal STB is a low level); and when the bit, corresponding to a certain heating unit, of the dot matrix data is a valid value (such as binary "1"), the heating unit is in an energized state, and energizing time is a duration of the valid strobe signal, and when the bit, corresponding to a certain heating unit, of the dot matrix data is an invalid value (such as binary "0"), the heating unit is in an un-energized state, so that each heating unit of the printing head 151 is in the energized state or the un-energized state according to the bit corresponding to the heating unit when the control unit 11 provides the valid strobe signal, and when the heating units are in the energized state, the heating units emit heat, thereby forming the printing dots on the printing medium.

The medium driving unit 16 includes a motor driver 161, a motor 162 and a printing platen 163, wherein the motor driver 161 is configured to output current required by the rotation of an output shaft of the motor 162 according to the control signal provided by the control unit 11; and the printing platen 163 is in transmission connection with the output shaft of the motor 162, and when the output shaft of the motor 162 rotates, rotates along with the output shaft of the motor 162, thereby driving the printing medium to move in the medium conveying passage.

The embodiment of the disclosure also provides a control method for printer, and the control method for the printer provided by the embodiment of the disclosure is introduced below with reference to the drawings. It should be noted that the printer provided by the embodiment of the disclosure can be configured to execute the control method for the printer provided by the embodiment of the disclosure, and the control method for the printer provided by the embodiment of the disclosure can also be executed through the printer in the embodiment of the disclosure.

Figure 3:
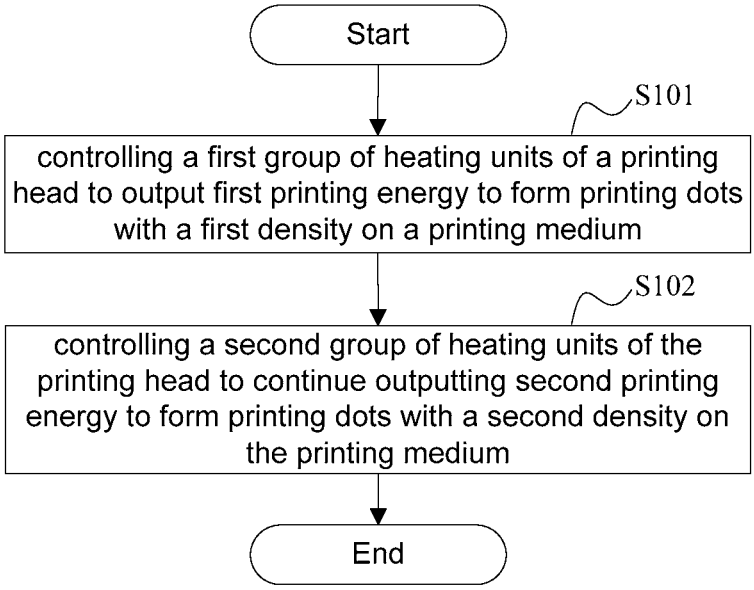
FIG. 3 is a flowchart of a control method for printer according to a first embodiment of the disclosure.

FIG. 3 is a flowchart of a control method for printer according to a first embodiment of the disclosure. As shown in FIG. 3, the method includes the following steps:

Step 101: controlling a first group of heating units of a printing head to output first printing energy to form printing dots with a first density on a printing medium, wherein the first printing energy is printing energy output by the first group of heating units heating according to corresponding bits of first dot matrix data, and the first dot matrix data is dot matrix data obtained by processing received printing data.

A control unit 11 sequentially processes data (i.e. printing control commands and printing data) received by a communication unit 12, and generates original dot matrix data, i.e. the first dot matrix data.

The control unit 11 transmits the first dot matrix data to the printing head 151, so that each heating unit of the printing head 151 outputs basic printing energy, i.e. the first printing energy, to form the printing dots with a certain density on the printing medium.

Step 102: controlling a second group of heating units of the printing head to continue outputting second printing energy to form printing dots with a second density on the printing medium, wherein the second printing energy is printing energy output by the second group of heating units heating according to corresponding bits of second dot matrix data, and the second dot matrix data is dot matrix data obtained by processing the first dot matrix data and configured for printing energy compensation, wherein the second group of heating units consists of the heating units need to implement printing energy compensation in the first group of heating units.

The control unit 11 acquires sequence numbers of first heating units and second heating units, performs first processing on the first dot matrix data according to the sequence numbers of the first heating units, and performs second processing on the first dot matrix data according to the sequence numbers of the second heating units, to obtain compensated dot matrix data, i.e. the second dot matrix data. Wherein, performing first processing on the first dot matrix data according to the sequence numbers of the first heating units includes: performing first processing on the bits of the first dot matrix data corresponding to the first heating units to keep the bits of the second dot matrix data corresponding to the first heating units unchanged; and performing second processing on the first dot matrix data according to the sequence numbers of the second heating units includes: performing second processing on the bits of the first dot matrix data corresponding to the second heating units to make the bits of the second dot matrix data corresponding to the second heating units be invalid values. Wherein the first heating units are heating units need to implement printing energy compensation, and the second heating units are heating units need not to implement printing energy compensation.

The control unit 11 transmits the second dot matrix data to the printing head 151, so that each heating unit of the printing head 151 outputs compensated printing energy, i.e. the second printing energy, and printing is re-executed on the basis of the printing density in Step 101 to improve the printing density and fulfil the aim of printing energy compensation.

The first group of heating units includes the first heating units and the second heating units, the first group of heating units consisting of the first heating units and the second heating units executes printing in Step 101, and the second group of heating units consisting of the first heating units executes printing in Step 102.

Corresponding to the control method for the printer provided by the embodiment of the disclosure, for the printer provided by the embodiment of the disclosure, the printing unit 15 includes the printing head 151 and a printing head driver 152, the printing head 151 includes multiple heating units which are arranged in a line at an equal interval along a width direction of the printing head, and the control unit 11 is configured to control the first group of heating units to output the first printing energy to form the printing dots with the first density on the printing medium and then control the second group of heating units to continue outputting the second printing energy to form the printing dots with the second density on the printing medium.

In the printer or the control method for the printer according to the embodiment of the disclosure, the heating units need to implement printing energy compensation continue outputting the compensated printing energy after outputting the basic printing energy, so that the printing densities of the printing dots corresponding to the heating units need to implement printing energy compensation are improved, and the problem of non-uniform printing density of each printing dot caused by non-uniform pressure exerted on the printing platen by the printing head can be effectively solved.

Figure 4A:
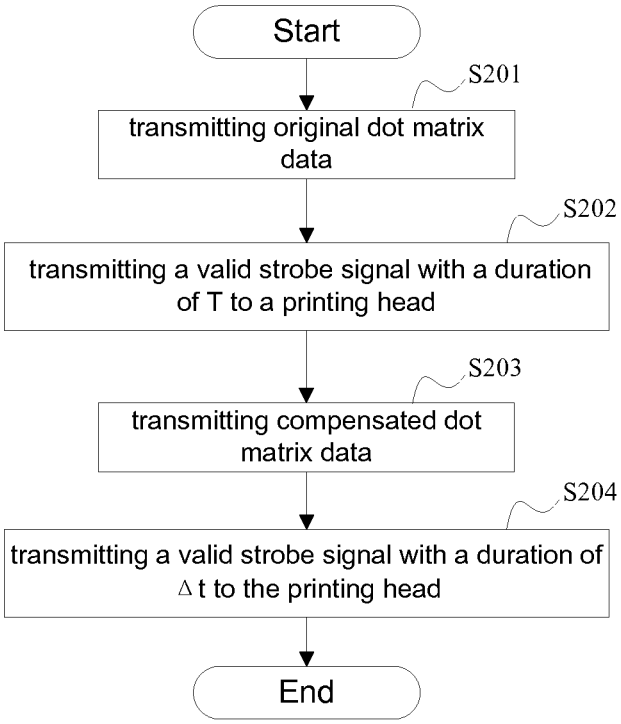
FIG. 4*a* is a flowchart of a control method for printer according to a second embodiment of the disclosure.

FIG. 4*a* is a flowchart of a control method for printer according to a second embodiment of the disclosure, and as shown in FIG. 4*a*, the method includes the following steps:

Step 201: transmitting original dot matrix data.

A communication unit receives data from a printing request device, and stores the data in a receiving buffer of a RAM, wherein the data received by the communication unit includes printing control commands and printing data; the control unit sequentially processes the printing control commands and the printing data, which are stored in the receiving buffer, generates the original dot matrix data, and stores the original dot matrix data in the printing buffer; when the printer starts a printing task, the control unit reads the one-dot line original dot matrix data stored in the printing buffer, transmits a clock signal CLK, and transmits each bit of the original dot matrix data to a printing head driver under the synchronization of the clock signal CLK; and when the original dot matrix data is transmitted completely, the control unit transmits a valid latch signal to the printing head driver after a preset time interval of t1, and the printing head driver latches the received bits of the original dot matrix data into the corresponding heating units.

Step 202: transmitting a valid strobe signal with a duration of T to the printing head.

After another preset time interval of t2, the control unit transmits the valid strobe signal to the printing head driver, the duration of the valid strobe signal is T, each heating unit of the printing head is controlled to or not to emit heat according to the corresponding bit of the dot matrix data, and the heated heating units output basic printing energy to form a printed image consisting of printing dots on a printing medium, wherein the duration T of the valid strobe signal determines the heating time of the heating units controlled to emit heat, that is, a printing density of the printing dots formed on the printing medium after the basic printing energy is output is determined.

Step 203: transmitting compensated dot matrix data.

The control unit reads a compensation sequence number N stored in the RAM, looks up a heating unit comparison table, acquires sequence numbers of the heating units need to implement printing energy compensation according to the compensation sequence number N, processes the original dot matrix data stored in the printing buffer according to the sequence numbers of the heating units need to implement printing energy compensation, generates the compensated dot matrix data, and stores the compensated dot matrix data in the printing buffer; the control unit transmits the compensated dot matrix data stored in the printing buffer to the printing head driver under the synchronization of the clock signal CLK; and when the compensated dot matrix data is transmitted completely, the control unit transmits a valid latch signal to the printing head driver after the preset time interval of t1, and the printing head driver latches bits of the received compensated dot matrix data into the corresponding heating units.

Figure 4B:
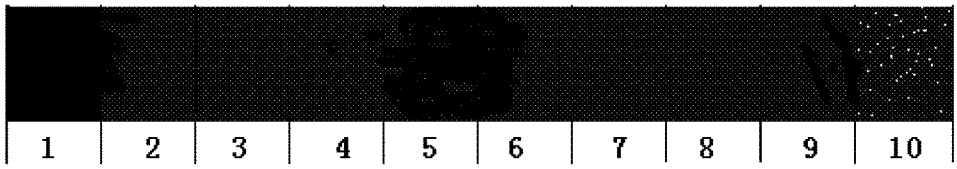
FIG. 4*b* is a diagram of a printing result of a test proof according to the disclosure.

The compensation sequence number N may be transmitted to the printer through the printing request device by a user, and may also be pre-stored in a Flash memory, and when the compensation sequence number N is pre-stored in the Flash memory, the control unit reads the compensation sequence number N stored in the Flash memory when the printer is energized, and stores the compensation sequence number N in the RAM. A value of the compensation sequence number N is determined by the user according to a printing effect of the printer, and when the user is dissatisfied with the printing effect of the printer, the user prints a test proof, a printing area of the test proof is divided into a plurality of sections along the width direction of the printing head in the test proof, each section of the printing area corresponds to each value of the compensation sequence number N, the user detects whether the printing density of each printing dot in the test proof is consistent or not, and when the printing density of each printing dot is inconsistent, the value of the compensation sequence number N is determined according to the printing area where the printing dots with lower printing densities are located. FIG. 4*b* is a diagram of a printing result of a test proof according to the disclosure, and as shown in FIG. 4*b*, the printing dots with the lower printing densities exist in the printing area with a sequence number of 10 in the test proof, and then the user determines the value of the compensation sequence number N to be 10.

An acquisition method for the compensated dot matrix data may include: processing the original dot matrix data according to the sequence numbers of the heating units need to implement printing energy compensation. Because the bits of the original dot matrix data stored in the printing buffer correspond to the heating units of the printing head one to one, each bit of the original dot matrix data is processed by: performing first processing on the bits corresponding to the heating units need to implement printing energy compensation to keep the bits corresponding to the heating units in the compensated dot matrix data unchanged, for example, performing "AND" operation on the bits corresponding to the heating units need to implement printing energy compensation in the original dot matrix data and "1" to enable the heating units need to implement printing energy compensation to output the printing energy according to the received original dot matrix data; and performing second processing on the bits corresponding to the heating units need not to implement printing energy compensation to make the bits corresponding to the heating units in the compensated dot matrix data be invalid values, for example, performing "AND" operation on the bits corresponding to the heating units need not to implement printing energy compensation in the original dot matrix data and "0" to ensure that the corresponding heating units do not output the printing energy after the compensated dot matrix data is received.

Step 204: transmitting a valid strobe signal with a duration of Δt to the printing head.

After the preset time interval of t2, the control unit transmits the valid strobe signal to the printing head driver, the duration of the valid strobe signal is Δt, the heating units need to implement printing energy compensation are controlled to or not to emit heat according to the corresponding bits of the compensated dot matrix data, and the heating units controlled to emit heat output the compensated printing energy to reform printing dots with a certain density on the printing medium to improve the printing densities, wherein $\Delta t = p*T$, that is Δt is calculated according to a compensated energy percentage p stored in the Flash memory and strobing time T after the transmission of the original dot matrix data, and the compensated energy percentage p is preset by the user according to the printing density of each printing dot after the transmission of the original dot matrix data. For example, the user prints the test proof, and detects and determines that the printing density of the printing dots in the printing area of a certain section is required to be improved by 10 percent to be consistent with that of the printing dots in the other sections, so that the user can set p to be 10 percent, and then the printing energy output by the heating units of the printing area of the section is improved by 10 percent when printing is executed.

Figure 4C:
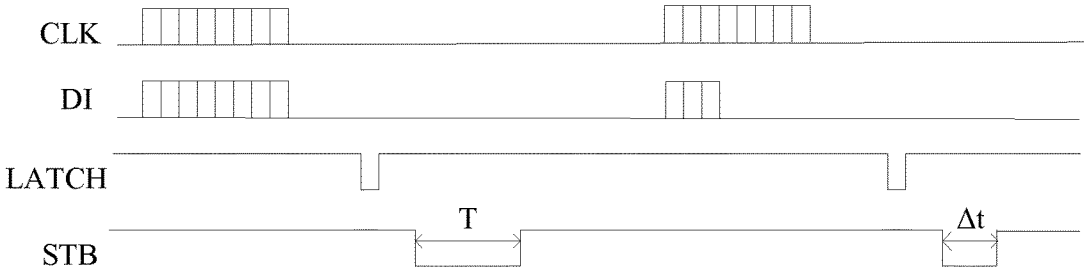
FIG. 4*c* is a related signal sequence diagram of a control method for printer according to a second embodiment of the disclosure.

FIG. 4*c* is a related signal sequence diagram of a control method for printer according to a second embodiment of the disclosure, and shows a control sequence of each related signal when the printer prints the one-dot line dot matrix data. As shown in FIG. 4*c*, the control unit continues transmitting the compensated dot matrix data to the printing unit after finishing transmitting the original dot matrix data to the printing unit through a data line DI, the duration of a valid state of the strobe signal STB after the transmission of the original dot matrix data is T, and the duration of the valid state of the strobe signal STB after the transmission of the compensated dot matrix data is Δt. According to the embodiment, the heating units need to implement printing energy compensation continue outputting the compensated printing energy after outputting the basic printing energy, so that the printing density of the printing dots corresponding to the heating units need to implement printing energy compensation is improved; and the heating units need not to implement printing energy compensation are not required to continue outputting the printing energy, and the printing density of the printing dots corresponding to the heating units need not to implement printing energy compensation is kept unchanged, so that the uniformity of the printing density of each printing dot on the printing medium is ensured.

Figure 5:
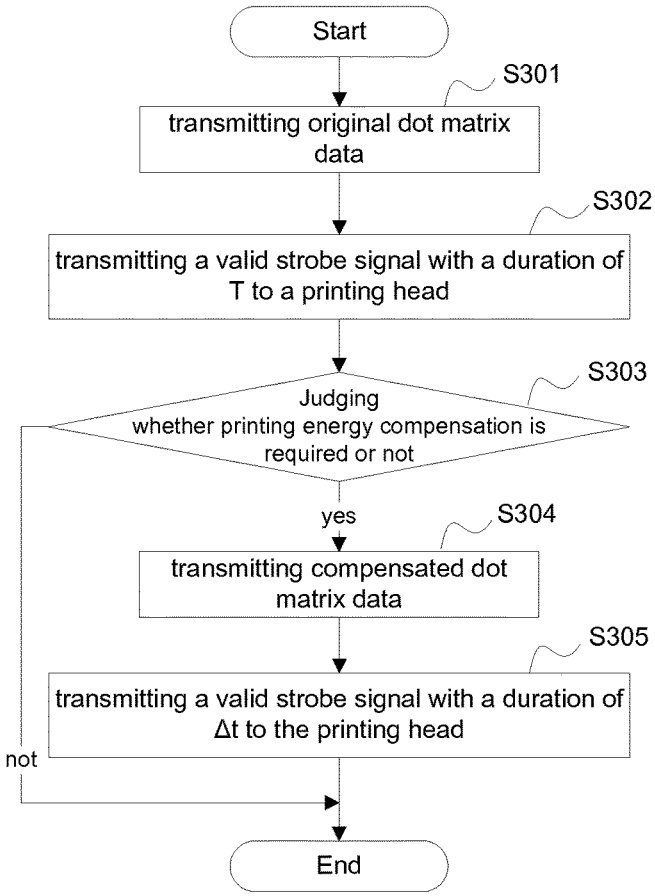
FIG. 5 is a flowchart of a control method for printer according to a third embodiment of the disclosure.

FIG. 5*a* is a flowchart of a control method for printer according to a third embodiment of the disclosure, and the method includes the following steps:

Step 301: transmitting original dot matrix data.

A specific implementation method is the same as that in Step 201.

Step 302: transmitting a valid strobe signal with a duration of T to a printing head.

A specific implementation method is the same as that in Step 202.

Step 303: judging whether printing energy compensation is required or not.

The control unit reads a printing compensation Flag stored in a RAM, and judges whether the printer is required to perform printing energy compensation or not, Step 304 is executed if the printer is required to perform printing energy compensation, and Step 306 is executed if the printer is not required to perform printing energy compensation.

Wherein, the printing compensation Flag may be transmitted to the printer through a printing request device by a user, and may also be pre-stored in a Flash memory, and when the printing compensation Flag is pre-stored in the Flash memory, the control unit reads the printing compensation Flag stored in the Flash memory when the printer is energized, and stores the printing compensation Flag in the RAM. A value of the printing compensation Flag, i.e. whether the printer is required to perform printing energy compensation or not during printing, is determined according to a printing effect of the printer by the user, and when the user is dissatisfied with the printing effect of the printer, the user prints a test proof, detects whether a printing density of each printing dot of the test proof is consistent or not, determines whether to perform printing energy compensation or not according to the printing density of each printing dot of the test proof, and determines a printing area of the printing head in need of printing energy compensation and a ratio by which the printing density of the printing dots corresponding to the printing area is to be improved to further determine values of a compensation sequence number N and a compensated energy percentage p.

Step 304: transmitting compensated dot matrix data.

A specific implementation method is the same as that in Step 203.

Step 305: transmitting a valid strobe signal with a duration of Δt to the printing head.

A specific implementation method is the same as that in Step 204.

In the embodiment, the user presets the printing compensation Flag, and the value of the printing compensation Flag is read to judge whether to perform printing energy compensation or not when the printer executes printing; and if the uniformity of the printing density of each printing dot of the printed image meets a requirement of the user, printing energy compensation is not required when the printer executes printing. By the control method according to the embodiment, the user can regulate the printing density more conveniently and flexibly when the printer is used.

The control methods for the printer according to the second embodiment and third embodiment of the disclosure may be printing control methods employing only once printing head strobing (called single-strobing printing for short) when the printer prints the one-dot line dot matrix data, and may also be printing control methods employing multiple printing head strobing (called multi-strobing printing for short) when the printer prints the one-dot line dot matrix data. When the printer prints the one-dot line dot matrix data, along with the heating of the heating units of the printing head for the formation of the printing dots on the printing medium under control, a motor drives the printing medium to move by a set distance (called a one-dot line distance for short) in a medium conveying passage, and under normal circumstances, when the printer prints the one-dot line dot matrix data, time for the movement of the printing medium by the one-dot line distance is far longer than the strobing time of the heating units, so that the printing head of the printer usually gates for many times in a process of movement of the printing medium by the one-dot line distance to uniformly distribute the strobing time for the printing of a dot line to the time for the movement of the printing medium by the one-dot line distance to ensure the uniformity of the printing density of each printing dot in a movement direction of the medium.

Figure 6A:
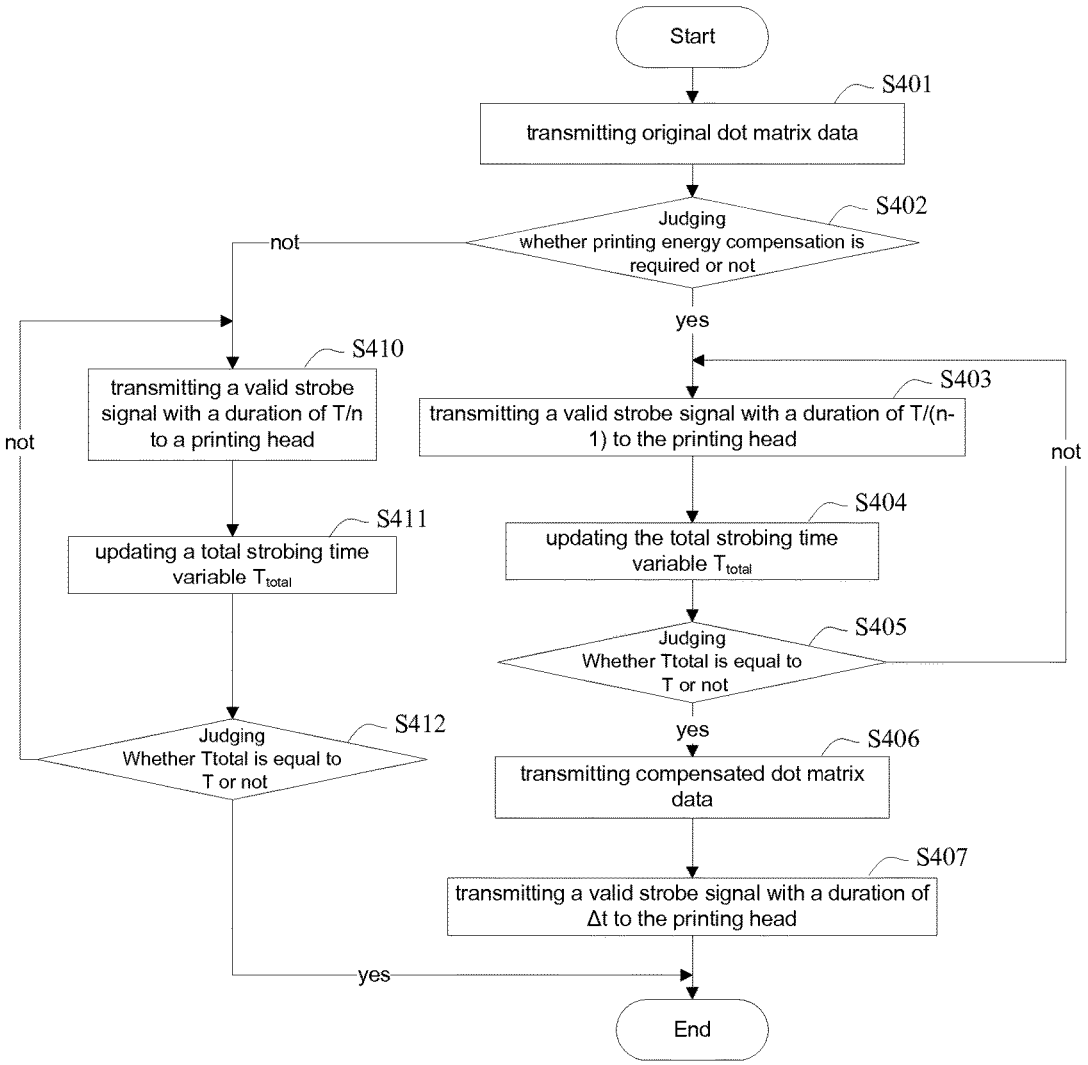
FIG. 6*a* is a flowchart of a control method for printer according to a fourth embodiment of the disclosure.

FIG. 6*a* is a flowchart of a control method for printer according to a fourth embodiment of the disclosure, the embodiment can be used as a preferred implementation mode of the first embodiment, and as shown in FIG. 6*a*, the method includes the following steps:

Step 401: transmitting original dot matrix data.

A specific implementation method is the same as that in Step 201.

Step 402: judging whether printing energy compensation is required or not.

The control unit reads a printing compensation Flag stored in a RAM, and judges whether the printer is required to perform printing energy compensation or not, Step 403 is executed if the printer is required to perform printing energy compensation, otherwise Step 410 is executed.

Step 403: transmitting a valid strobe signal with a duration of T/(n−1) to a printing head.

The control unit transmits the valid strobe signal to a printing head driver at a preset time interval of T0, the duration of the valid strobe signal is T/(n−1), wherein n is an integer more than 1, and is the number of strobing times of the printing head when the printer prints one-dot line dot matrix data when printing energy compensation is not required, and the preset time interval T0 is longer than the duration T/(n−1) of the valid strobe signal.

Step 404: updating a total strobing time variable $T_{total}$.

The control unit accumulates T/(n−1) to the total strobing time variable $T_{total}$ during the printing of the one-dot line dot matrix data, wherein the total strobing time variable $T_{total}$ is stored in a temporary buffer of the RAM, and a value of the variable is initialized to be 0 when the printer is energized for the first time.

Step 405: judging whether $T_{total}$ is equal to T or not.

The control unit reads the value of the total strobing time variable $T_{total}$ stored in the RAM, and judges whether the value is equal to preset strobing time T or not, Step 406 is executed if the value is equal to the preset strobing time T, otherwise Step 403 is continued.

Step 406: transmitting compensated dot matrix data.

When the value of the total strobing time variable $T_{total}$ is equal to the preset strobing time T, the control unit sets the value of the total strobing time variable $T_{total}$ to be 0, and simultaneously transmits compensated dot matrix data to the printing head, wherein an acquisition method for the compensated dot matrix data is the same as that in S203.

Step 407: transmitting a valid strobe signal with a duration of Δt to the printing head.

A specific implementation method is the same as that in Step 204.

Step 410: transmitting a valid strobe signal with a duration of T/n to the printing head.

The control unit transmits the valid strobe signal to the printing head driver at the preset time interval of T0, the duration of the valid strobe signal being T/n, wherein n is an integer more than 1, and is the number of strobing times of the printing head when the printer prints one-dot line dot matrix data when printing energy compensation is not required, and the preset time interval T0 is longer than the duration T/n of the valid strobe signal.

Step 411: updating the total strobing time variable $T_{total}$.

The control unit accumulates T/n to the total strobing time variable $T_{total}$ during the execution of printing.

Step 412: judging whether $T_{total}$ is equal to T or not.

The control unit reads the value of the total strobing time variable $T_{total}$ stored in the RAM, and judges whether the value is equal to preset strobing time T or not, the control unit sets the value of the total strobing time variable $T_{total}$ to be 0 if the value is equal to the preset strobing time T, otherwise Step 410 is continued.

Figure 6B:
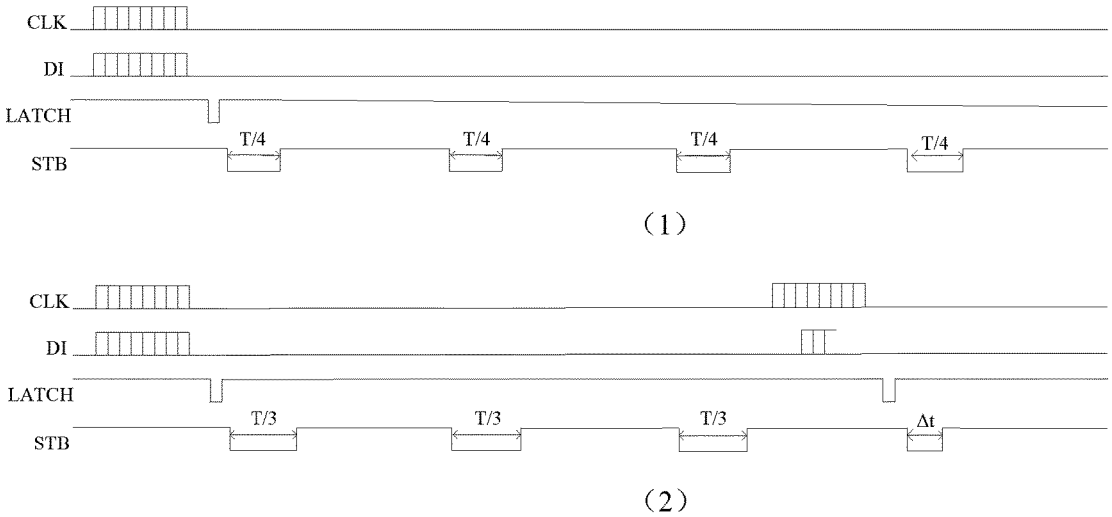
FIG. 6*b* is a related signal sequence diagram of a control method for printer according to a fourth embodiment of the disclosure.

FIG. 6*b* is a related signal sequence diagram of a control method for printer according to a fourth embodiment of the disclosure, and shows a control sequence of each related signal when the printer prints one-dot line dot matrix data by taking n=4 as an example. (1) in FIG. 6*b* shows a control sequence of each related signal when the printer is not required to perform printing energy compensation, and as shown by (1) in FIG. 6*b*, when the one-dot line dot matrix data is printed, the printing head totally gates for four times after the control unit finishes transmitting original dot matrix data to the printing head, wherein a duration of a valid state of a strobe signal STB during the strobing of each time is T/4, so that the total strobing time of each heating unit of the printing head is T when the one-dot line dot matrix data is printed; (2) in FIG. 6*b* shows a control sequence of each related signal when the printer is required to perform printing energy compensation, and as shown by (2) in FIG. 6*b*, the printing head totally gates for three times after the control unit finishes transmitting original dot matrix data to the printing head, wherein the duration of the valid state of the strobe signal STB during the strobing of each time is T/3, and then the control unit transmits compensated dot matrix data to the printing head, and transmits a valid strobe signal, wherein a duration of a valid state of the strobing STB is Δt, so that the heating units need to implement printing energy compensation are continuously strobed for Δt after each heating unit to emit heat of the printing head is strobed for T when the one-dot line dot matrix data is printed.

The control method of the embodiment is applied to a multi-strobing printing condition, and in the embodiment, when printing energy compensation is required, the strobing time when the printing head is strobed is prolonged from T/n to T/(n−1) after the control unit finishes transmitting the original dot matrix data to the printing head, and the total strobing time after the printing head be strobed for (n−1) times reaches T, so that compared with the condition where printing energy compensation is not required, the printing energy outputted during each time the printing head be gate is improved, and after the printing head be strobed for (n−1) times, the basic printing energy can be completely outputted by the printing head; and then the control unit transmits the compensated dot matrix data to the printing head, and transmits the valid strobe signal with the duration of Δt, so that the heating units need to implement printing energy compensation continue outputting the compensated printing energy during the printing head be strobed for nth time. By the control method of the embodiment, the uniformity of the printing density of each printing dot in the movement direction of the medium is ensured, and meanwhile, the heating units need to implement printing energy compensation continue outputting the compensated printing energy, so that the uniformity of the printing density of each printing dot is ensured.

According to the embodiment of the disclosure, the heating units need to implement printing energy compensation continue outputting the second printing energy, namely compensation printing energy, after the first printing energy, i.e. the basic printing energy, is outputted, so that the printing densities of the printing dots corresponding to the heating units need to implement printing energy compensation are improved; and the heating units need not to implement printing energy compensation are not required to continue outputting the printing energy, and the printing density of the printing dots corresponding to the heating units need not to implement printing energy compensation is kept unchanged, so that the uniformity of the printing density of each printing dot on the printing medium is ensured.

The above is only the preferred embodiment of the disclosure and not intended to limit the disclosure, and for those skilled in the art, the disclosure can have various modifications and variations. Any modifications, equivalent replacements, improvements and the like within the spirit and principle of the disclosure shall fall within the scope of protection of the disclosure.

What is claimed is:

1. A control method for a printer, comprising:

controlling a first group of heating units of a printing head to output first printing energy to form printing dots with a first density on a printing medium, wherein the first printing energy is printing energy output by the first group of heating units heating according to corresponding bits of first dot matrix data, and the first dot matrix data is dot matrix data obtained by processing received printing data; and controlling a second group of heating units of the printing head to output second printing energy to form printing dots with a second density on the printing medium, wherein the second printing energy is printing energy output by the second group of heating units heating according to corresponding bits of second dot matrix data, and the second dot matrix data is dot matrix data obtained by processing the first dot matrix data and configured for printing energy compensation, wherein the second group of heating units consists of heating units that need to implement printing energy compensation in the first group of heating units, wherein, in the process of controlling the second group of heating units of the printing head to output second printing energy to form printing dots with a second density on the printing medium, heating units that need not implement printing energy compensation in the first group of heating units are not required to output the second printing energy, wherein controlling the first group of heating units of the printing head to output the first printing energy to form the printing dots with the first density on the printing medium comprises:

transmitting the first dot matrix data to a printing head driver;

controlling the printing head driver to latch the bits of the first dot matrix data into corresponding heating units; and transmitting a first valid strobe signal with a duration of T to the printing head driver to control the first group of heating units to output the first printing energy; and wherein controlling the second group of heating units of the printing head to continue outputting the second printing energy to form the printing dots with the second density on the printing medium comprises:

transmitting the second dot matrix data to the printing head driver;

controlling the printing head driver to latch the bits of the second dot matrix data into the corresponding heating units; and transmitting a second valid strobe signal with a duration of Δt to the printing head driver to control the second group of heating units to output the second printing energy, wherein Δt=p*T, and p is a compensated energy percentage preset according to the printing density of the printing dots after the transmission of the first dot matrix data.

2. The control method according to claim 1, wherein the first valid strobe signal comprises multiple third valid strobe signals, and in a process of printing one-dot line dot matrix data by a printer, the multiple third valid strobe signals are transmitted to the printing head driver, and sum of durations of the multiple third valid strobe signals is T, wherein the multiple third valid strobe signals are transmitted to the printing head driver comprises that:

the third valid strobe signals are transmitted to the printing head driver at a preset time interval of T0, and the duration of each third valid strobe signal is T/(n−1), wherein n is an integer more than 1, and is the number of strobing times of the printing head when the one-dot line dot matrix data is printed by the printer when printing energy compensation is not required, and the preset time interval T0 is longer than the duration T/(n−1).

3. The control method according to claim 1, before controlling the second group of heating units of the printing head to continue outputting the second printing energy to form the printing dots with the second density on the printing medium, further comprising:

reading a printing compensation Flag stored in a Random Access Memory (RAM) of a printer to judge whether the printer needs printing energy compensation or not, wherein the second group of heating units of the printing head is controlled to continue outputting the second printing energy to form the printing dots with the second density on the printing medium when the printer is determined to need to implement printing energy compensation.

4. The control method according to claim 1, wherein the second dot matrix data is obtained by:

acquiring sequence numbers of first heating units, acquiring sequence numbers of second heating units, performing first processing on the first dot matrix data according to the sequence numbers of the first heating units, and performing second processing on the first dot matrix data according to the sequence numbers of the second heating units, wherein performing first processing on the first dot matrix data according to the sequence numbers of the first heating units comprises: performing first processing on the bits of the first dot matrix data corresponding to the first heating units to keep the bits of the second dot matrix data corresponding to the first heating units unchanged; and performing second processing on the first dot matrix data according to the sequence numbers of the second heating units comprises: performing second processing on the bits of the first dot matrix data corresponding to the second heating units to make the bits of the second dot matrix data corresponding to the second heating units be an invalid value, wherein the first heating units are heating units need to implement printing energy compensation, and the second heating units are heating units need not to implement printing energy compensation.

5. A printer, comprising:

a printing unit, comprises a printing head and a printing head driver, wherein the printing head comprises multiple heating units which are arranged in a line at an equal interval along a width direction of the printing head; and a control unit, configured to control a first group of heating units to output first printing energy to form printing dots with a first density on a printing medium and then control a second group of heating units to output second printing energy to form printing dots with a second density on the printing medium, wherein the first printing energy is printing energy output by the first group of heating units heating according to corresponding bits of first dot matrix data, the first dot matrix data is dot matrix data obtained by processing received printing data, the second printing energy is printing energy output by the second group of heating units heating according to corresponding bits of second dot matrix data, the second dot matrix data is dot matrix data obtained by processing the first dot matrix data and configured for printing energy compensation, and the second group of heating units consists of the heating units that need to implement printing energy compensation in the first group of heating units, wherein, heating units that need not implement printing energy compensation in the first group of heating units are configured to not be required to output the second printing energy, wherein the control unit is further configured to:

transmit the first dot matrix data to the printing head driver, control the printing head driver to latch the bits of the first dot matrix data into the corresponding heating units, transmit a first valid strobe signal with a duration of T to the printing head driver to control the first group of heating units to output the first printing energy, transmit the second dot matrix data to the printing head driver, control the printing head driver to latch the bits of the second dot matrix data into the corresponding heating units, and transmit a second valid strobe signal with a duration of $\Delta t$ to the printing head driver to control the second group of heating units to output the second printing energy, wherein $\Delta t = p*T$, and p is a compensated energy percentage preset according to the printing density of the printing dots after the transmission of the first dot matrix data.

6. The printer according to claim 5, wherein the first valid strobe signal comprises multiple third valid strobe signals, the control unit is configured to, in a process of printing one-dot line dot matrix data by the printer, transmit the multiple third valid strobe signals to the printing head driver, and the sum of durations of the multiple third valid strobe signals is T, wherein the control unit is configured to transmit the multiple third valid strobe signals to the printing head driver in a manner of:

transmitting the third valid strobe signals to the printing head driver at a preset time interval of T0, and the duration of each third valid strobe signal is T/(n−1), wherein n is an integer more than 1, and is the number of strobing times of the printing head when the one-dot line dot matrix data is printed by the printer when printing energy compensation is not required, and the preset time interval T0 is longer than the duration T/(n−1).

7. The printer according to claim 5, further comprising:

a Random Access Memory (RAM), configured to store a printing compensation Flag, wherein the control unit is further configured to, before controlling the second group of heating units of the printing head to continue outputting the second printing energy to form the printing dots with the second density on the printing medium, read the printing compensation Flag stored in the RAM of the printer to judge whether the printer needs printing energy compensation or not, and control the second group of heating units of the printing head to continue outputting the second printing energy to form the printing dots with the second density on the printing medium when the printer is determined to need to implement printing energy compensation.

8. The printer according to claim 5, wherein the control unit is configured to obtain the second dot matrix data by:

acquiring sequence numbers of first heating units, acquiring sequence numbers of second heating units, performing first processing on the first dot matrix data according to the sequence numbers of the first heating units, and performing second processing on the first dot matrix data according to the sequence numbers of the second heating units, wherein performing first processing on the first dot matrix data according to the sequence numbers of the first heating units comprises: performing first processing on the bits of the first dot matrix data corresponding to the first heating units to keep the bits of the second dot matrix data corresponding to the first heating units unchanged; and performing second processing on the first dot matrix data according to the sequence numbers of the second heating units comprises: performing second processing on the bits of the first dot matrix data corresponding to the second heating units to make the bits of the second dot matrix data corresponding to the second heating units be invalid values, wherein the first heating units are heating units need to implement printing energy compensation, and the second heating units are heating units need not to implement printing energy compensation.

* * * * *